US007331836B1

(12) United States Patent
Harris

(10) Patent No.: US 7,331,836 B1
(45) Date of Patent: Feb. 19, 2008

(54) AQUATIC APPAREL

(75) Inventor: William R. Harris, Panora, IA (US)

(73) Assignee: Shirley A. Harris, Panora, IA (US)

( * ) Notice: Subject to any disclaimer, the term of this patent is extended or adjusted under 35 U.S.C. 154(b) by 0 days.

(21) Appl. No.: 11/032,276

(22) Filed: Jan. 10, 2005

Related U.S. Application Data

(60) Provisional application No. 60/538,737, filed on Jan. 23, 2004.

(51) Int. Cl.
*B63C 9/08* (2006.01)
*B63C 9/11* (2006.01)

(52) U.S. Cl. ..... 441/88; 441/106

(58) Field of Classification Search ..... 441/88, 441/102–119; 2/DIG. 3
See application file for complete search history.

(56) References Cited

U.S. PATENT DOCUMENTS

| | | | | |
|---|---|---|---|---|
| 3,400,415 | A * | 9/1968 | Scheurer | 441/112 |
| 3,562,812 | A * | 2/1971 | Greggains | 2/94 |
| 4,551,107 | A * | 11/1985 | Scheurer et al. | 441/112 |
| 4,863,409 | A * | 9/1989 | Johnson et al. | 441/80 |
| 5,361,418 | A * | 11/1994 | Luzenske | 2/338 |
| 5,514,019 | A * | 5/1996 | Smith | 441/88 |
| 5,619,751 | A * | 4/1997 | Ray et al. | 2/102 |
| 6,122,778 | A * | 9/2000 | Cohen | 5/81.1 R |
| 6,168,488 | B1 * | 1/2001 | Yu-Tsai | 441/106 |
| 6,910,224 | B2 * | 6/2005 | Ikenaga et al. | 2/102 |

* cited by examiner

*Primary Examiner*—Ajay Vasudeva
(74) *Attorney, Agent, or Firm*—Robert J. Harris

(57) ABSTRACT

An article of aquatic apparel including one or more handles. The handles are secured to the apparel and allow for passengers riding along to hold onto the wearer of the article. The handles can be configured as gripping slots or projecting straps.

4 Claims, 14 Drawing Sheets

AQUATIC APPAREL

PRIORITY OF INVENTION

This application claims priority from U.S. Provisional Application No. 60/538,737, filed 23 Jan. 2004. The entire contents of this provisional application is hereby incorporated herein by reference.

BACKGROUND

In the last 10 to 15 years the use of personal watercraft has dramatically increased in the United States. Along with an increased interest in riding has come an increased interest in machines with higher performance. Today, personal watercraft machines are capable of reaching speeds in excess of 50 miles an hour. It is also quite popular to ride today's machines over rough water and over wakes produced by other craft to increase the thrill and the enjoyment of riding.

In addition to being faster, today's personal water craft are also larger. As a result, they are capable of carrying multiple riders. Due to the increased speeds and the tendency to ride over rough waters, it can be difficult for passengers to stay on the watercraft. Currently, passengers stabilize themselves by holding on to parts on the watercraft, or by wrapping their arms around the driver. Unfortunately, at high speeds and on rough water it can be difficult to maintain a grip on the driver—especially if the driver and/or the passenger are wet. Accordingly, the passenger can frequently lose her hold on the driver and be thrown from the watercraft.

Currently there is a need for devices and methods that are useful to help watercraft passengers stay on their watercraft.

SUMMARY

In one embodiment, an article of aquatic apparel comprising one or more handles is provided. In addition to aiding passengers with holding onto the driver or another passenger, such an article can also provide convenience, since it can be used to assist someone with removing the wearer of the article from the water. For example, the handle can be used to pull someone from the water in a rescue situation or it can be used by one passenger to assist another passenger with remounting the craft.

In another embodiment, a method for a watercraft passenger to hold onto a watercraft driver or to another watercraft passenger includes the watercraft passenger holding on to one or more handles that are associated with apparel worn by the driver or the other passenger.

DETAILED DESCRIPTION

In accordance with the description that follows, an article of aquatic apparel includes one or more handles. The one or more handles allow for passengers that are riding on a personal water craft, to hold onto the driver or another passenger in order to keep their balance or to remain on the water craft. They also can assists in removing a wearer of the article from the water. For example, the aquatic apparel can be used to pull someone from the water in a rescue situation. In another example, it can be used by one passenger in assisting another passenger in remounting the personal water craft.

Figure 1:
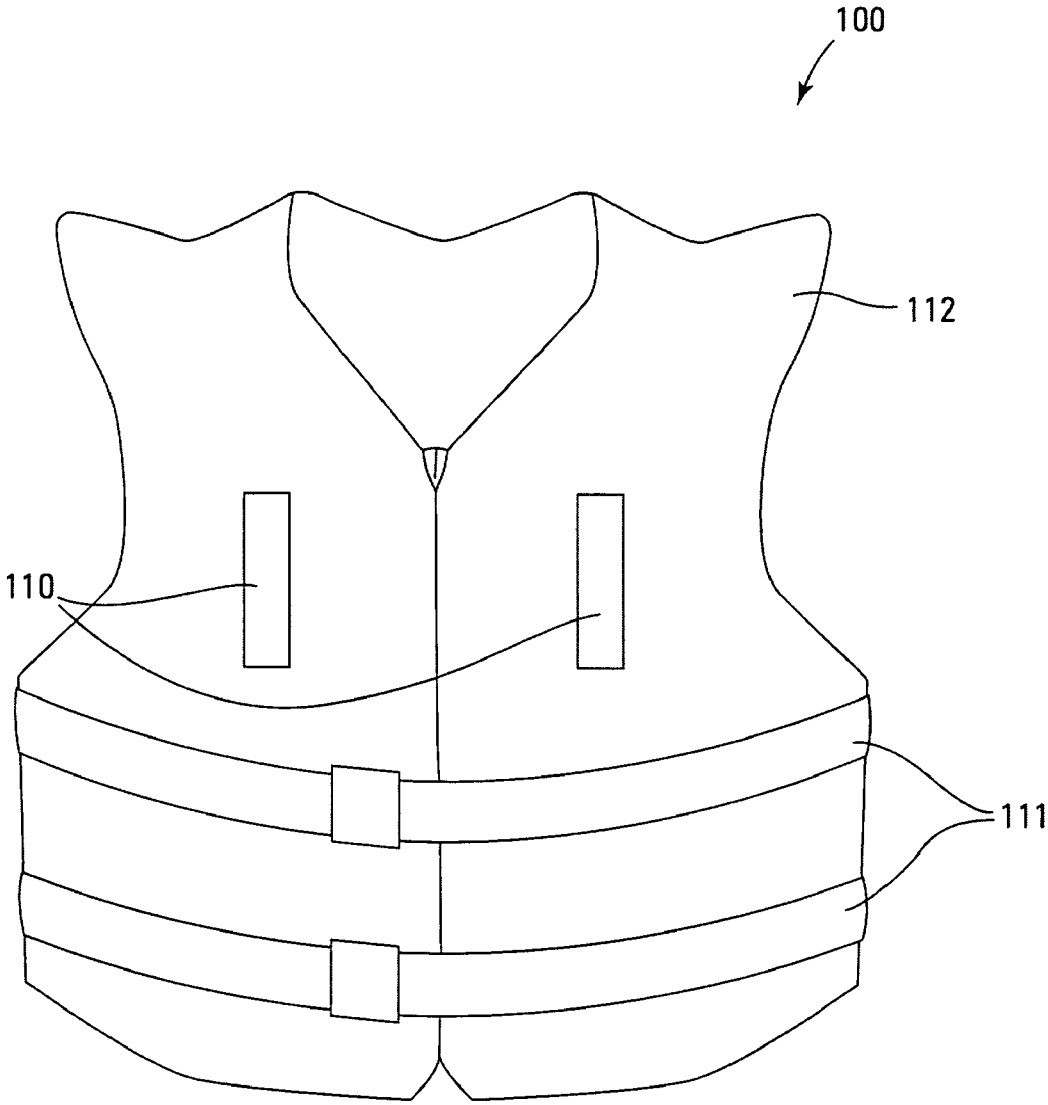
FIG. 1 illustrates a front view of the aquatic apparel in accordance with one embodiment.

Referring to FIG. 1, an aquatic apparel 100 is illustrated. In one example, a personal flotation device such as a life vest 105 is illustrated. The life vest includes attachment features 111, such as clips mounted to straps. The attachment features 111 allow for the aquatic apparel to be attached or secured around at least a portion of the wearer of the article. In one option the aquatic apparel 100 includes handles 110 that allow for a user that is seated behind the wearer of the vest to reach around to the front portion of the vest and grab onto the handles 110. For example, the vest includes one or more front panels that are worn near the chest. The vest further includes one or more handles 110 disposed along the front panels. In another option, the one or more handles 110 are disposed on a rear panel of the vest.

In one example, a first passenger wears the vest as illustrated in FIG. 1, and a second passenger is seated behind the first passenger. During use of the personal water craft, the second passenger reaches around the front of the first passenger and grasps the handles 110. In one option, the handles 110 are releasably mounted to the aquatic apparel or safety vest 100. For example, the handle is mounted to the vest 112 such that the handles are only released upon a significant impact of force. In another option, the vest 112 is provided with a plurality of handles 110 such that if one or more of the handles 110 are displaced or lost from being released additional handles can be replaced. In another option, the handles 110 are formed of a highly visible material and/or a floatable material and/or subcomponents, such that the articles can be retrieved from the water if they are displaced from the second passenger. The handle 110 can be releasably mounted in a number of manners, for example, snaps, breakaway stitching, and/or VELCRO™. In another option, the handles include features allowing the handles to be reattached after they are released from the vest or aquatic apparel 100.

Figure 2:
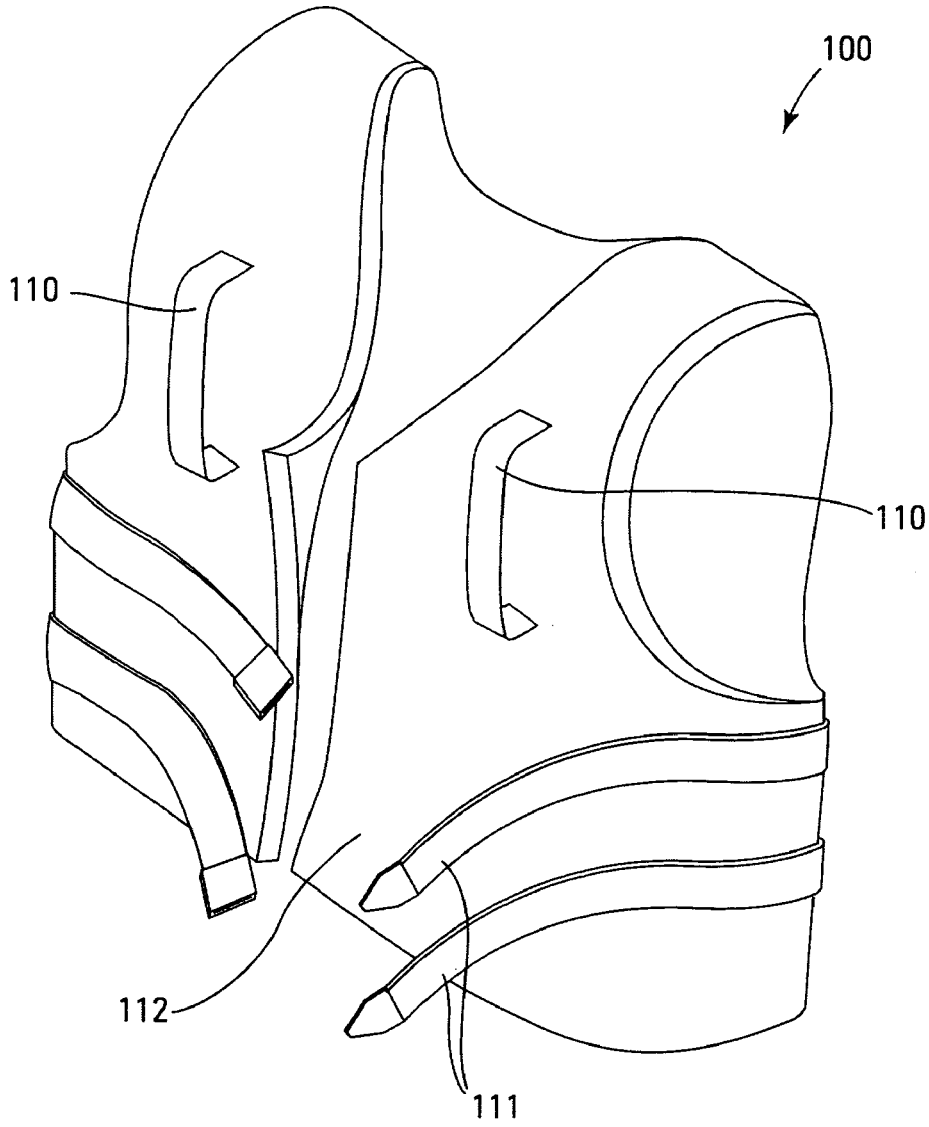
FIG. 2 illustrates a perspective view of the aquatic apparel in accordance with one embodiment.
Figure 3:
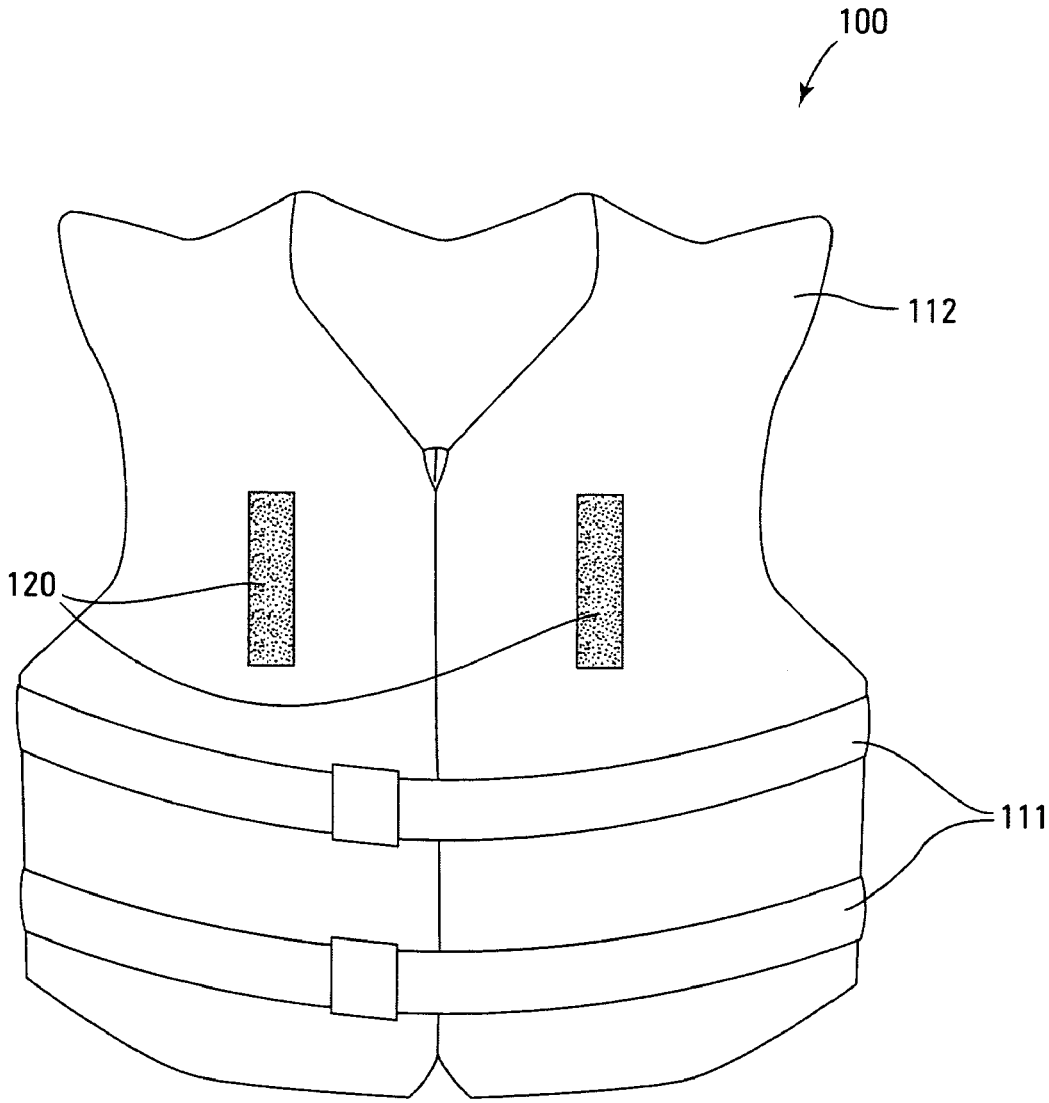
FIG. 3 illustrates a front view of the aquatic apparel in accordance with one embodiment.
Figure 4:
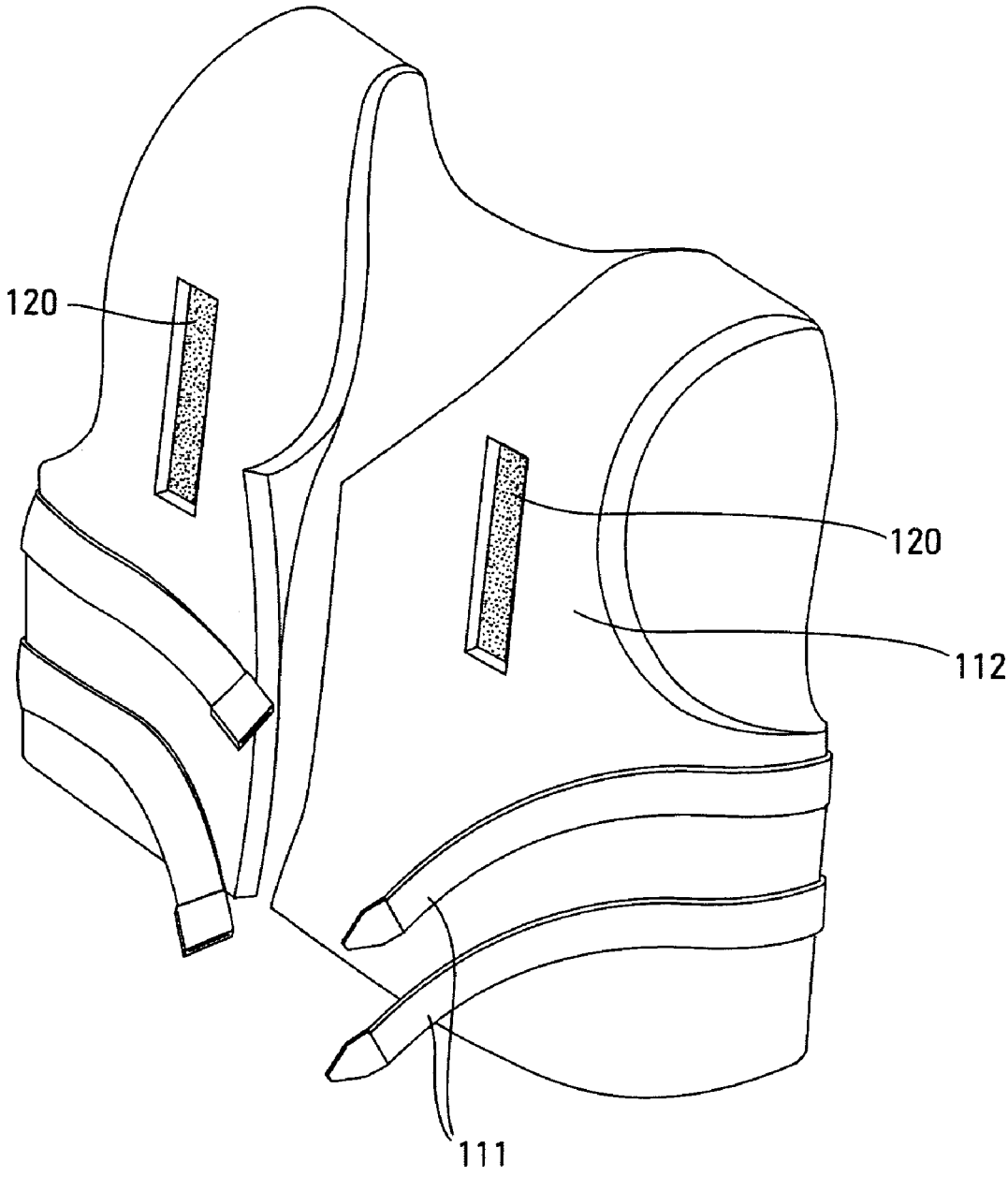
FIG. 4 illustrates a perspective view of the aquatic apparel in accordance with one embodiment.

In one option, the one or more handles 110 include extended handles, for example, straps, as illustrated in FIG. 2. In another example, as illustrated in FIGS. 3 and 4, the aquatic apparel 100 includes one or more slots 120, that are configured to be received therein by a human hand. The one or more slots 120 form recesses or apertures within the aquatic apparel that allow for a second passenger to grasp onto the aquatic apparel. In one option, the slots 120 and/or straps are disposed on a front panel of a safety vest. As evident in FIG. 4, the slots 120 are substantially rectangular in shape and extend substantially vertically. Each slot 120 is defined by two pairs of opposed walls extending between the outer and inner surfaces of the front panel to define an aperture through the aquatic apparel, for example, the vest 112. The opposed walls of the slot are spaced apart to define an opening that is wide enough to accommodate the fingers of a passenger's hand. In another option, the slots 120 and/or straps are disposed in a rear panel of the safety vest. In another option, the slots 120 and/or straps are disposed in a side panel of the safety vest.

Figure 5:
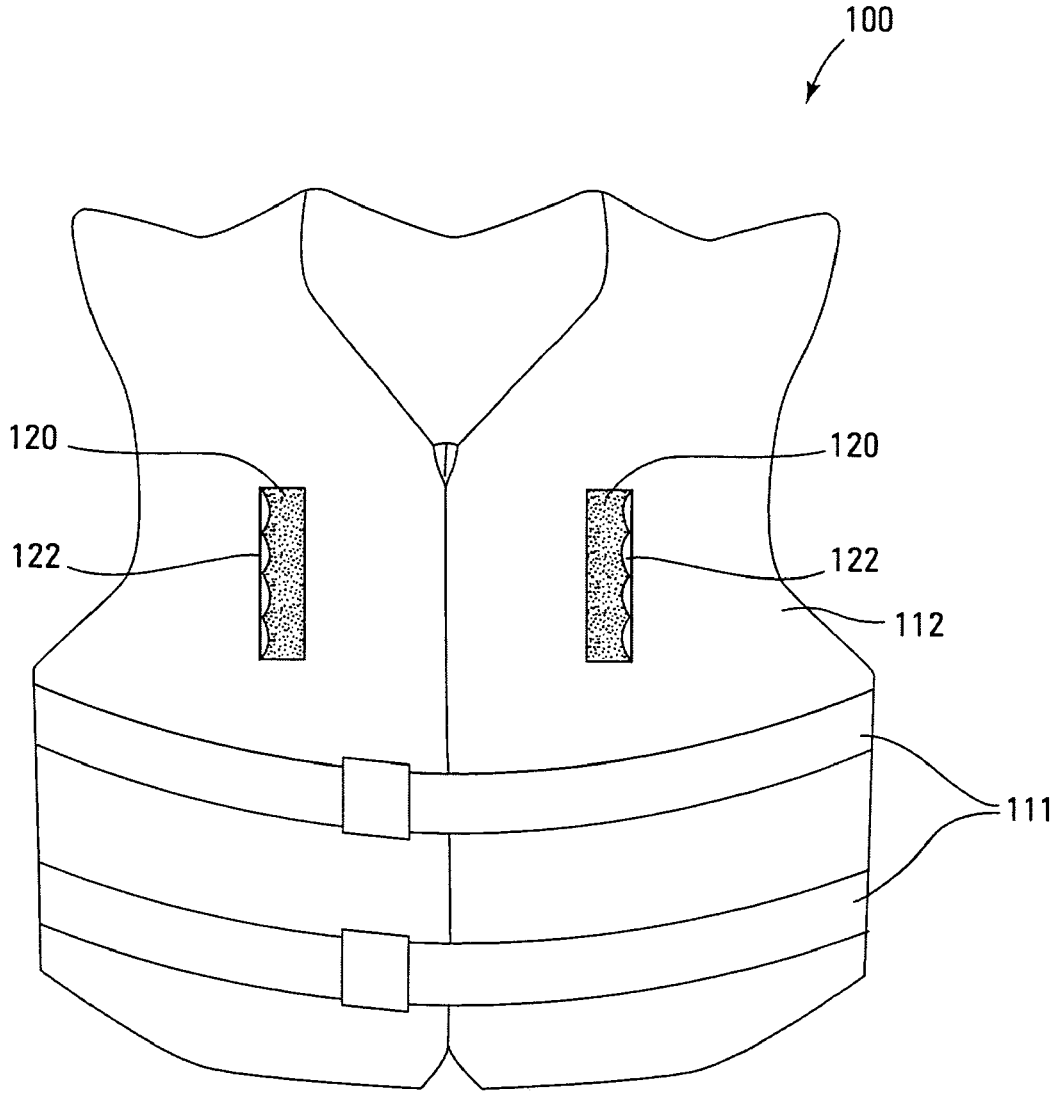
FIG. 5 illustrates a front view of the aquatic apparel in accordance with one embodiment.
Figure 6:
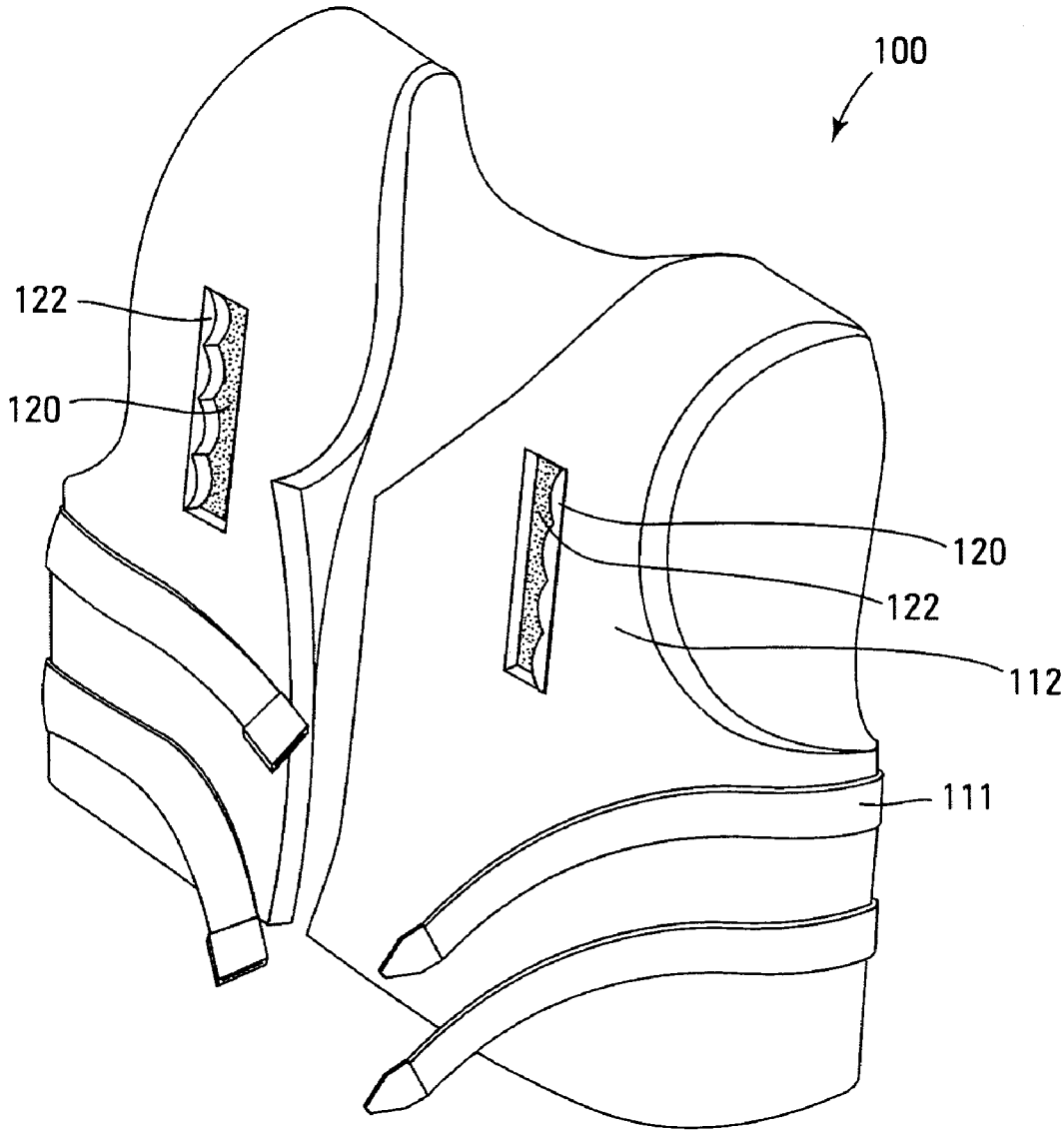
FIG. 6 illustrates a perspective view of the aquatic apparel in accordance with one embodiment.

FIGS. 5 and 6 illustrate another version of the aquatic apparel 100. In one option, the aquatic apparel includes one or more handles 120 that form recesses within the aquatic apparel, for example, the vest 112. In a further option, the one or more handles 120 include a plurality of raised portions 122, for example, features that provide a gripping portion. The plurality of raised portions 122 are formed proximal to the handles 120. For example, the raised portions 122 are formed within a portion of the handle, such as on a wall of the slot handle 120. In one option, the one or more raised portions 122 form structure that allows for fingers to be received therein. In another option, the one or more raised portions 122 can further include slip resistant material thereon further aiding the second passenger to grip onto another passenger wearing the aquatic apparel 100.

Figure 7:
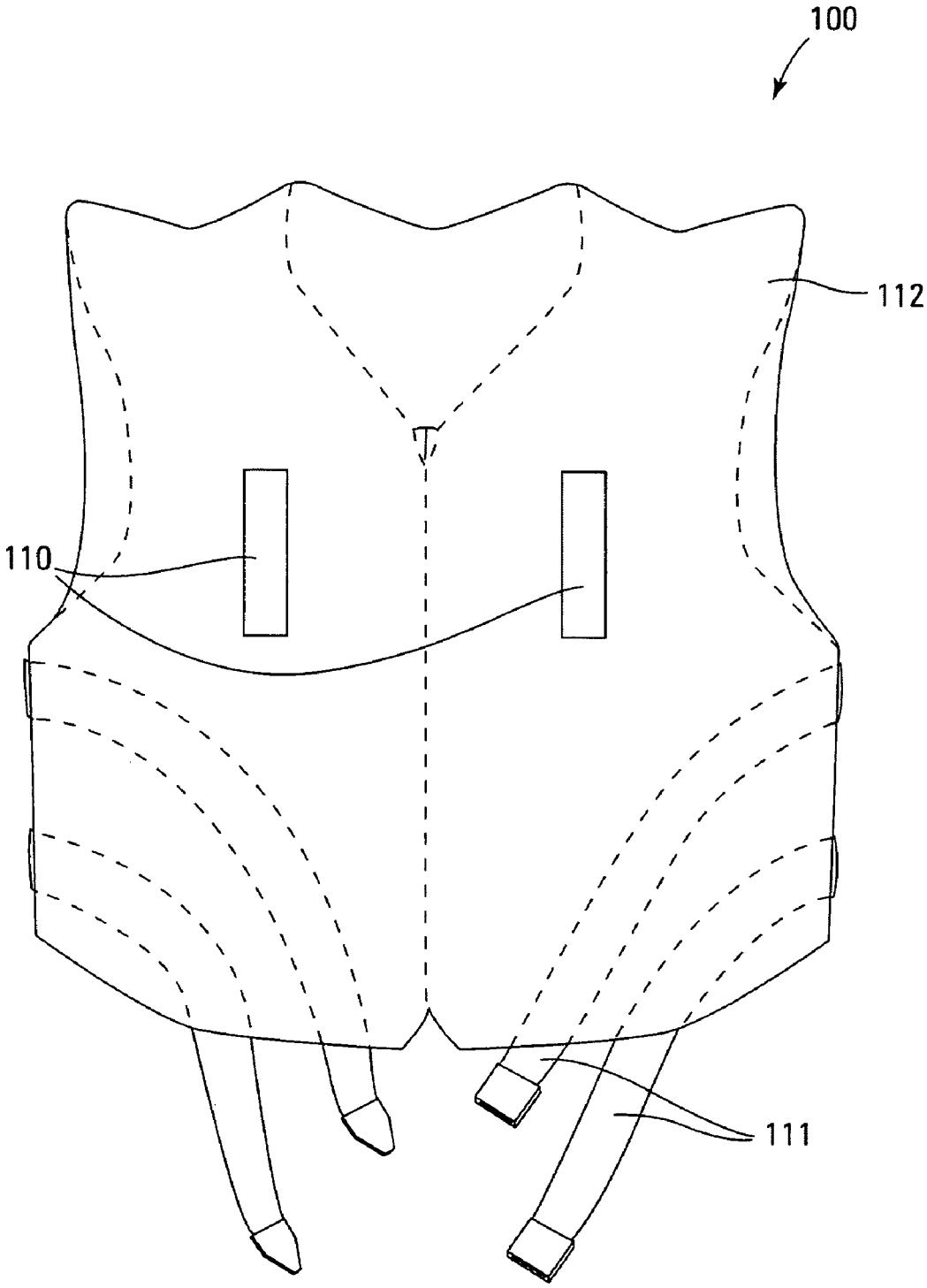
FIG. 7 illustrates a rear view of the aquatic apparel in accordance with one embodiment.
Figure 8:
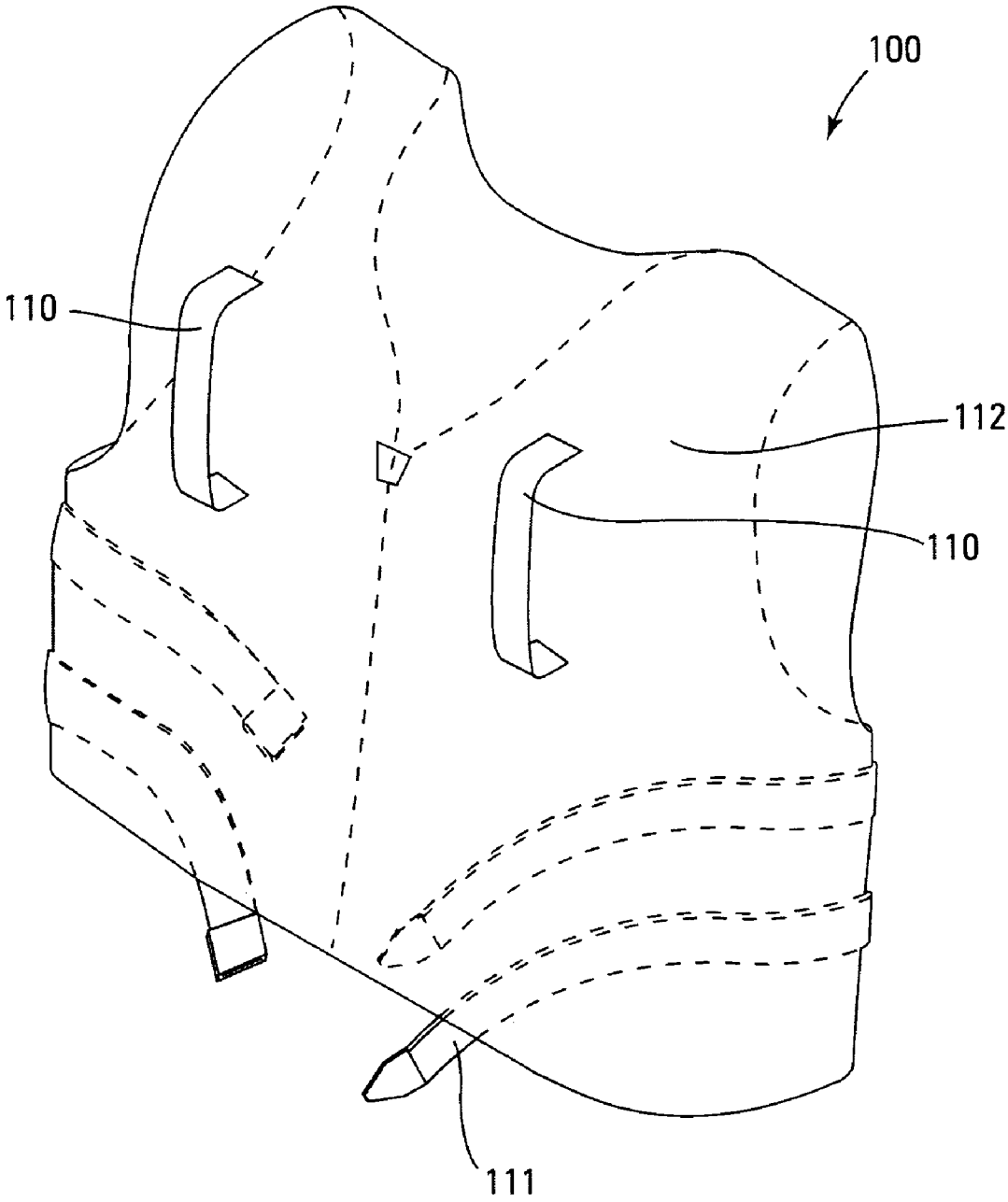
FIG. 8 illustrates a rear view perspective view of the aquatic apparel in accordance with one embodiment.

FIGS. 7 and 8 illustrate another embodiment for the aquatic apparel 100. As discussed above, a life vest 112 is illustrated. In one option, there are one or more handles 110 associated with the life vest 112. In one option, as illustrated in FIGS. 7 and 8, the one or more handles 110 are associated with a back portion of the life vest 112. In this option, a second passenger, for example, that is seated behind a first passenger can hold onto handles that are disposed on the back of the first passenger. Alternatively, if someone is trying to be retrieved from the water and is floating on their stomach the handles on the back of the vest can be used to retrieve the person from the water. As noted above, the handles 110 can be releasably coupled with the aquatic apparel 100, such as the safety vest 112.

It should be further noted that the one or more handles 110 can be disposed on the front portion of the aquatic apparel relative to the passenger, as illustrated in the earlier embodiments. In another option, as illustrated in FIGS. 7 and 8, the handles 110 can be associated with the back portion of the aquatic apparel, such as the safety vest 112. It should be further noted that the handles can be disposed in other locations such as in the shoulder area relative to the passenger, or a side area. Furthermore, the handles can be projecting from the vest formed a part of the vest, or recessed into the vest, or supplemental handles that are releasably coupled to the vest in the manners discussed above.

The aquatic apparel 110 further includes features 111 that allow for the apparel to be secured to the wearer. In one option, the features 111 include straps that are coupled together, for example, a snap fit, to secure the safety vest 112 to or around the wearer. In another option, the features may include zippers, VELCRO™, and the like.

Figure 9:
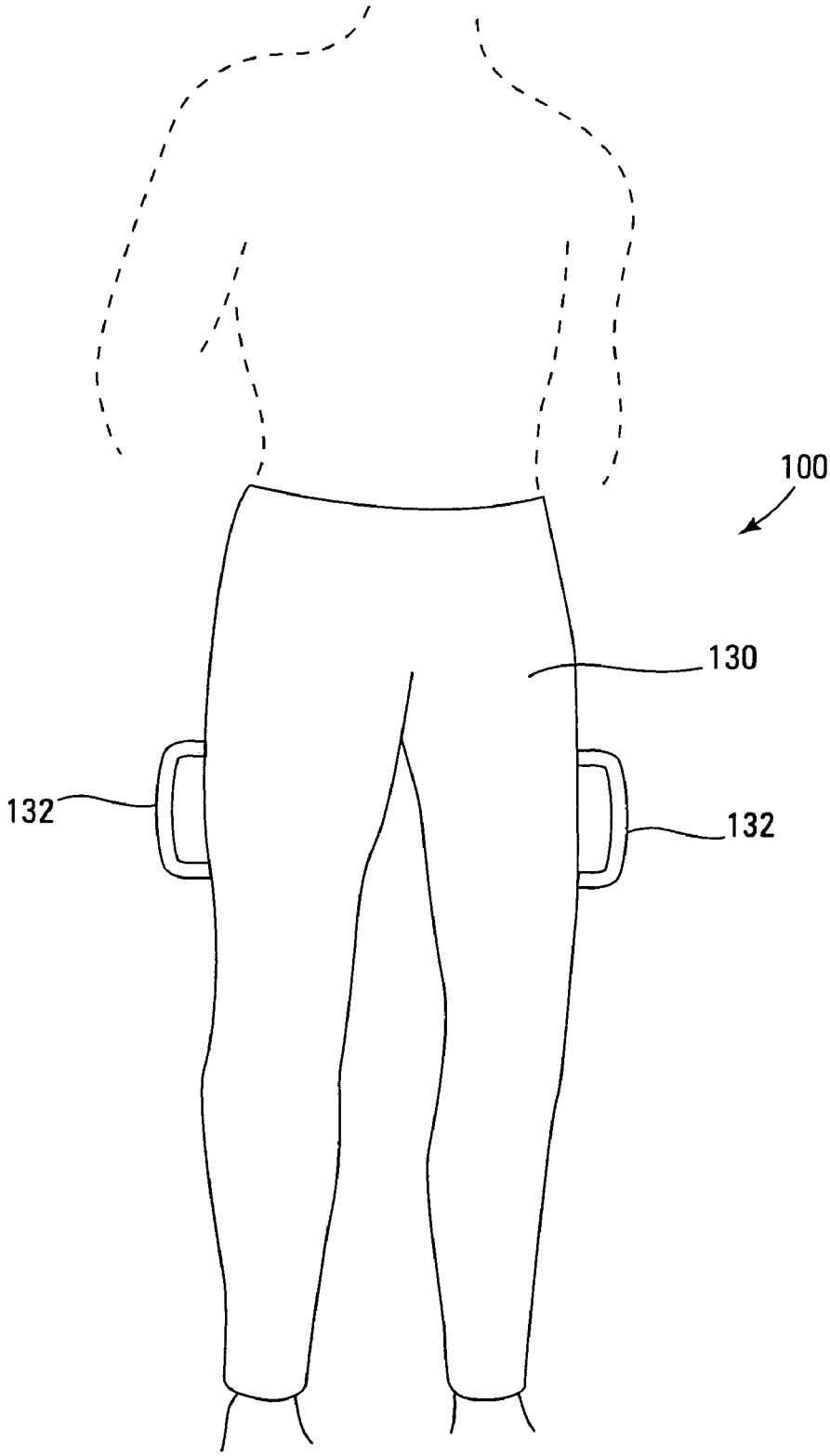
FIG. 9 illustrates a front perspective view of the aquatic apparel constructed in accordance with one embodiment.
Figure 10:
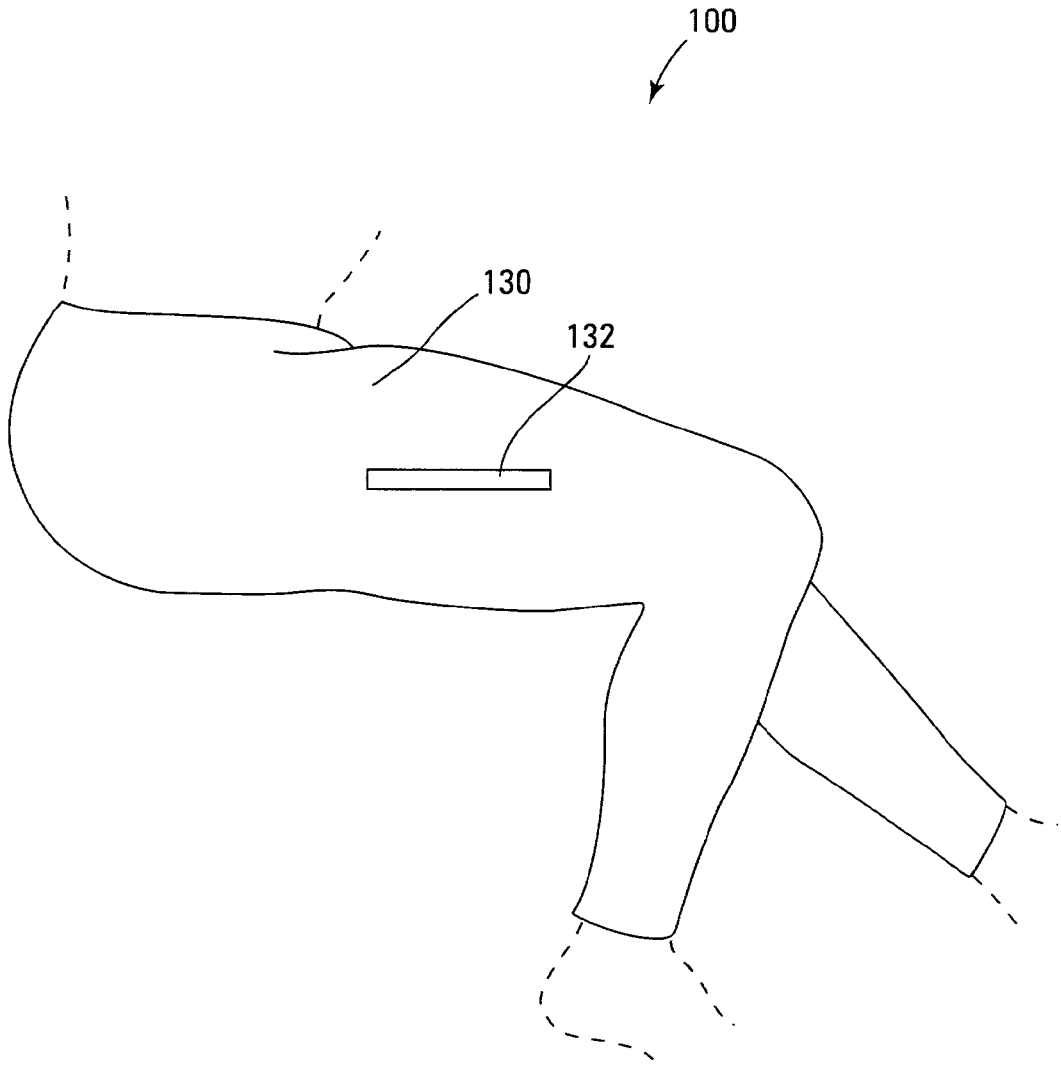
FIG. 10 illustrates a side view of aquatic apparel constructed in accordance with one embodiment.

FIGS. 9 and 10 illustrate another embodiment of aquatic apparel 100. In one option, the aquatic apparel 100 includes a wet suit, such as wet suit pants 130. It should be noted although wet suit pants 130 are discussed other variations of a wet suit (e.g. a dry suit) can be included in the scope of this application. The aquatic apparel, such as wet suit pants 130, further include one or more handles 132, that are configured, sized, and shaped to be grasped by a second passenger on a water sports vehicle. The handles 132 can include any of the above discussed embodiments. In one option, the handles include projecting members that extend from a portion of the aquatic apparel 100. In one option, the handles 132 extend from a side portion of the wet suit pants 130, for example, along a thigh portion of the wet suit 130. Other locations for the handles 132 are also considered within the scope of the disclosure materials herein.

Figure 11:
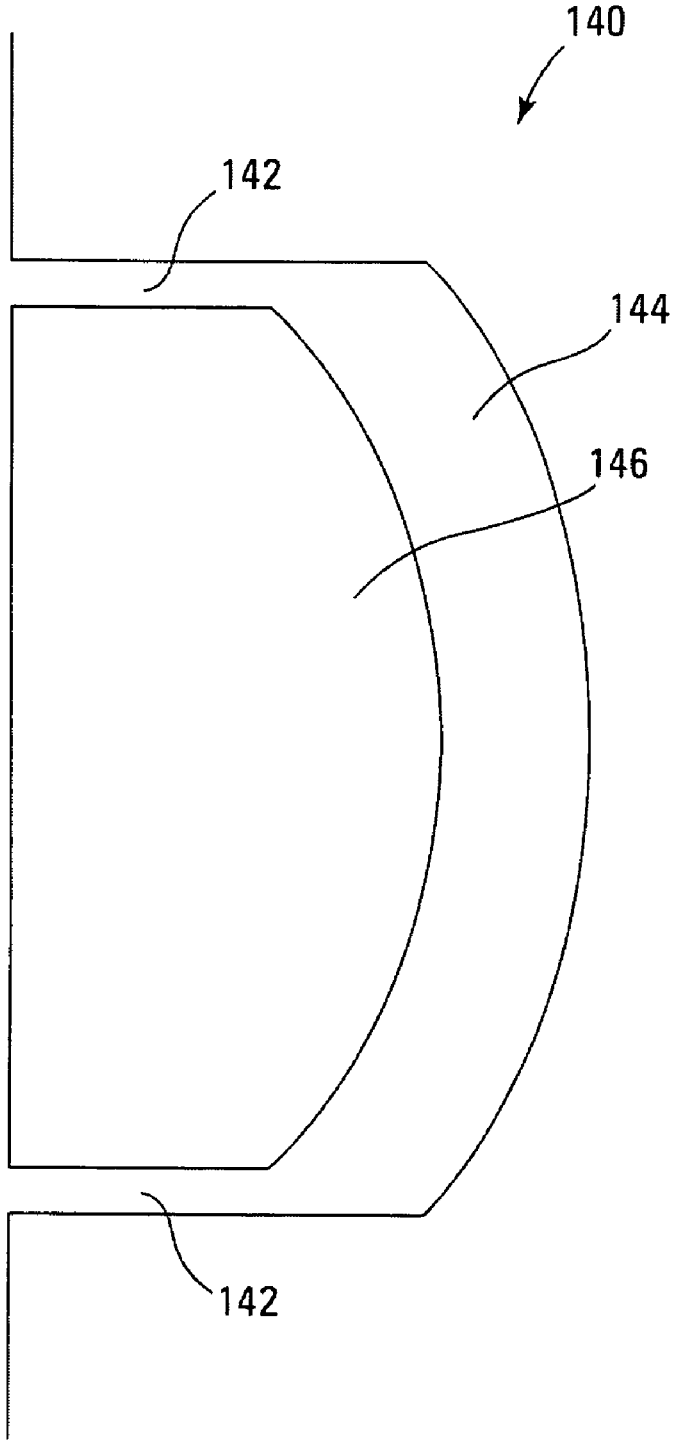
FIG. 11 illustrates a handle assembly constructed in accordance with one embodiment.

FIGS. 11 through 14 illustrate variations of the handles that could be used in accordance the above discussed embodiments. In one example, the handle includes, as illustrated in FIG. 11, a profile that has a widened portion 144 and more narrow portions 142. This further includes an open area 146 that allows for a users hand to be grasped therein. The widened portion 144 can, for example, be provided with a foam or cushion material allowing ease of use to the user. In the earlier portion referred to handles as with the element 140.

Figure 12:
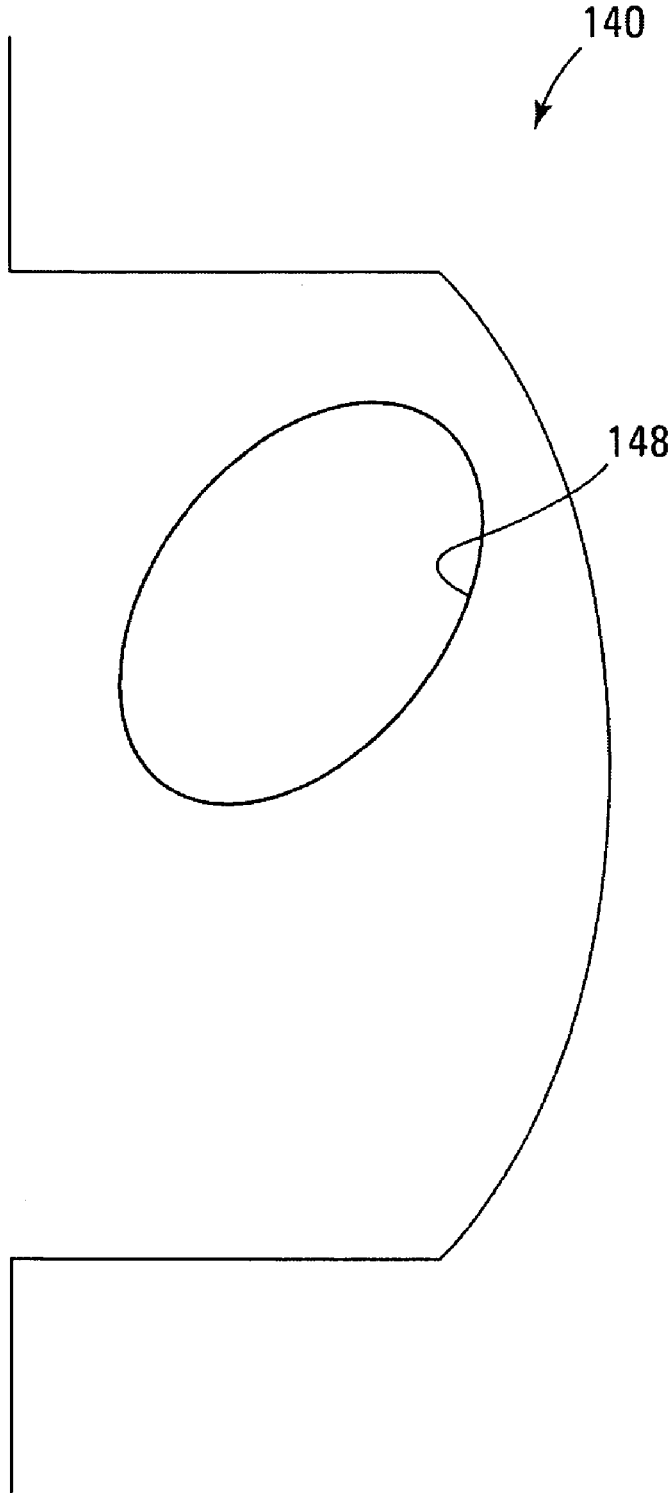
FIG. 12 illustrates a handle assembly constructed in accordance with one embodiment.

FIG. 12 illustrates another example of a profile of one or more handles 140. In one option, the one or more handles 140 includes a circular, or a somewhat circular opening 148 allowing for a user to grasp therein. Furthermore, avoiding the use of hard angles with respect to forming the recess 148 a further assisted manufacturability it also assists in preventing degradation of the one or more handles 140 during repeated use of the device. In another option, the recess 148 can be sized and configured to be used as a finger or thumb hole in conjunction with the handle 140.

Figure 13:
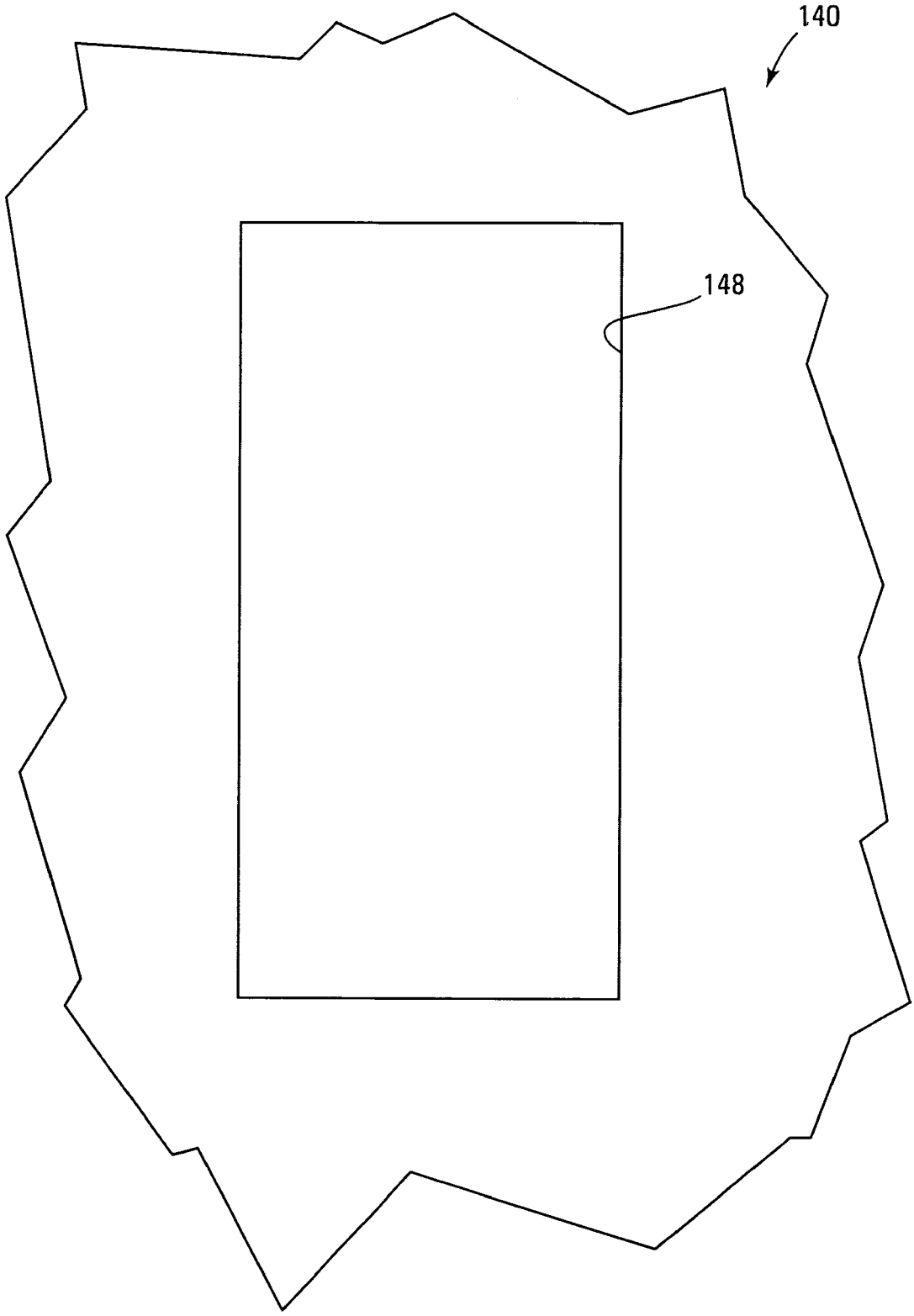
FIG. 13 illustrates a handle assembly constructed in accordance with one embodiment.
Figure 14:
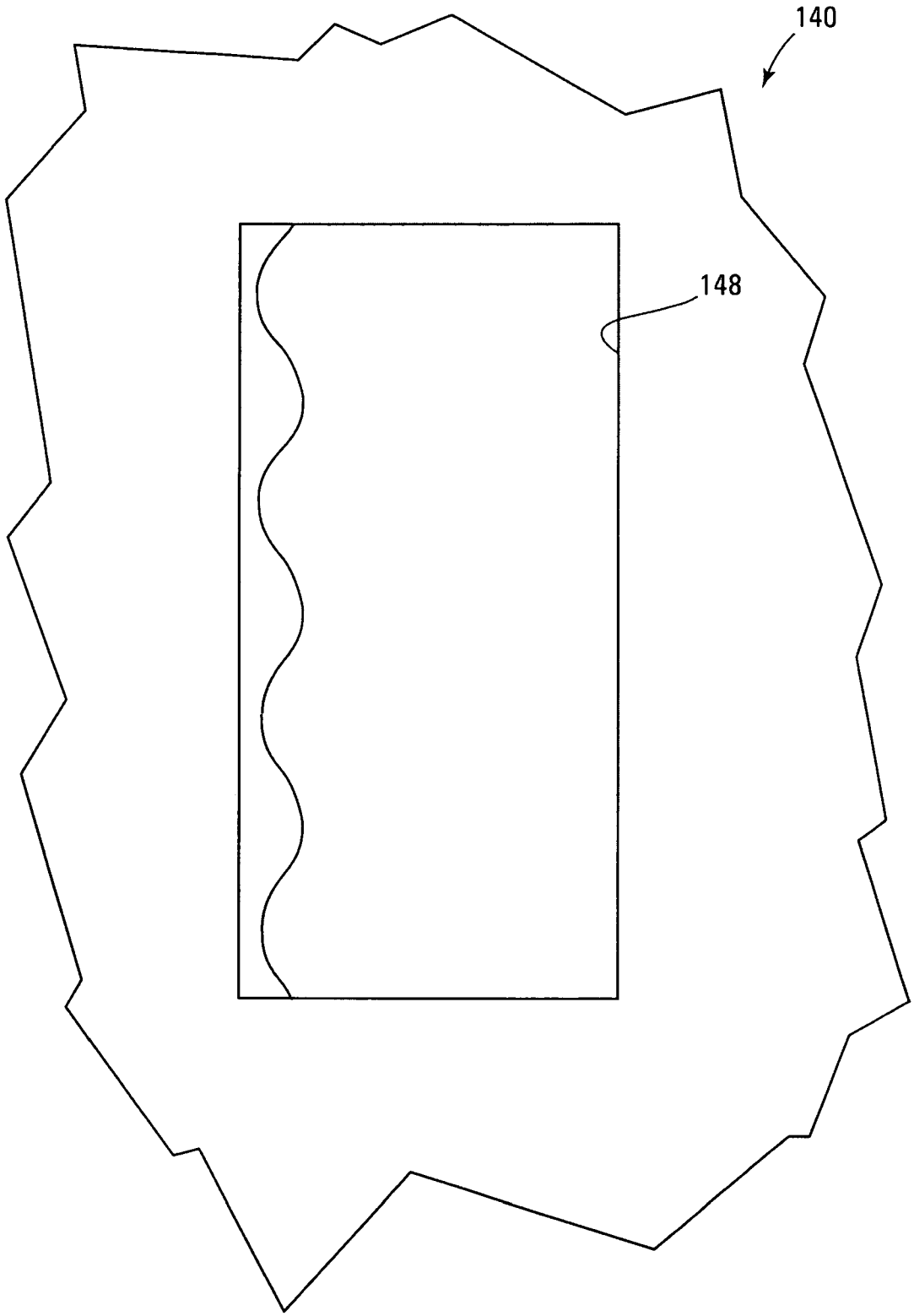
FIG. 14 illustrates a handle assembly constructed in accordance with one embodiment.

FIGS. 13 and 14 illustrate further variations for the handle portion 140. In one option the recessed portion allowing for a user to grip therein includes a rectangular or square shape. In another option, as illustrated in FIG. 14, the recess 148 may be further provided with projections such as recesses or a wave guide for receiving fingers therein. As further discussed above, one or more portions of the handle portions 140 may be provided with slip resistant features, further allowing for the fingers to be grasped therein.

The one or more handles that are provided with the aquatic apparel described above, allow for an enhanced benefit in allowing for passengers to secure themselves, or at least feel like they can secure themselves, to other passengers on water sport vehicles in a manner that prevents them or assists them in preventing themselves from falling off the vehicle. It also allows for them to do it in a number of matters, it allows for passengers who may not know each other very well to comfortably do so. The handles, in another embodiment, are releasably mounted to the aquatic apparel allowing for release if the forces are too great and assisting and preventing injury to the users. The release can be predetermined and set at a preset limit to avoid injury. In one example, the apparel of the invention can be sized for someone other than an infant or a child. For example, in one example, the apparel can be sized to be worn by a human adult.

All publications, patents, and patent documents are incorporated by reference herein, as though individually incorporated by reference. The invention has been described with reference to various specific and preferred embodiments and techniques. However, it should be understood that many variations and modifications may be made while remaining within the spirit and scope of the invention.

What is claimed is:

1. An aquatic apparel comprising:

a life vest configured as a personal flotation device for a wearer, the life vest defining a neck opening, a torso opening, and a pair of opposed arm holes;

the life vest having at least one front panel extending over the wearer's chest and a rear panel extending over the wearer's back, each of the front panel and the rear panel having outer and inner surfaces;

the life vest including an attachment feature configured for securing the life vest around at least a portion of the wearer of the life vest;

the life vest further having one or more substantially rectangular slots for use as handles, wherein each substantially rectangular slot is oriented substantially vertically and sized for receiving a hand of an adult human, wherein each substantially rectangular slot is defined by two pairs of opposed walls extending between the outer and inner surfaces of the front panel or the rear panel to define an aperture through the life vest, the opposed walls of each pair being spaced away from each other, and wherein at least one wall of each slot comprises a plurality of raised portions to accommodate the fingers of hand to permit the user to grip the life vest.

2. The aquatic apparel of claim 1, wherein said one or more substantially rectangular slots comprise two or more substantially rectangular slots.

3. The aquatic apparel of claim 1, wherein said one or more substantially rectangular slots comprise one substantially rectangular slot positioned on the outer surface of the front panel such that it will be in front of an individual wearing the apparel.

4. The aquatic apparel of claim 1, wherein said one or more substantially rectangular slots comprise two or more substantially rectangular slots positioned on the outer surface of the front panel such that it will be in front of an individual wearing the apparel.

* * * * *